United States Patent [19]

Barger

[11] Patent Number: 4,525,268

[45] Date of Patent: Jun. 25, 1985

[54] COMBINATION PROCESS FOR UPGRADING RESIDUAL OILS

[75] Inventor: Dwight F. Barger, Russell, Ky.

[73] Assignee: Ashland Oil, Inc., Ashland, Ky.

[21] Appl. No.: 550,985

[22] Filed: Nov. 10, 1983

Related U.S. Application Data

[63] Continuation of Ser. No. 401,059, Jul. 23, 1982, abandoned.

[51] Int. Cl.[3] ..... C10G 51/02

[52] U.S. Cl. ..... 208/73; 208/88; 208/91; 208/251 R

[58] Field of Search ..... 208/89, 88, 91, 73, 208/251 R, 67

[56] References Cited

U.S. PATENT DOCUMENTS

| | | | |
|---|---|---|---|
| 2,378,531 | 6/1945 | Becker | 208/91 |
| 2,462,891 | 3/1949 | Noll | 208/73 X |
| 3,365,389 | 1/1968 | Spars et al. | 208/89 |
| 4,147,617 | 4/1979 | Nace | 208/73 |
| 4,263,128 | 4/1981 | Bartholic | 208/251 R |
| 4,309,274 | 1/1982 | Bartholic | 208/91 |

*Primary Examiner*—Delbert E. Gantz
*Assistant Examiner*—Cynthia S. Prezlock
*Attorney, Agent, or Firm*—Richard C. Wilson, Jr.; Carl D. Farnsworth

[57] ABSTRACT

A combination operation for upgrading reduced crudes is described which particularly restricts the contact time between hydrocarbons, solid sorbent material and cracking catalyst particles whereby quenching of visbroken product vapors is eliminated, coke formation is substantially restricted and catalytic cracking of hot product vapors of visbreaking contributes to the catalytic cracking thereof in a time-temperature restricted atmosphere providing substantial yields of gasoline and gasoline precursors.

11 Claims, 1 Drawing Figure

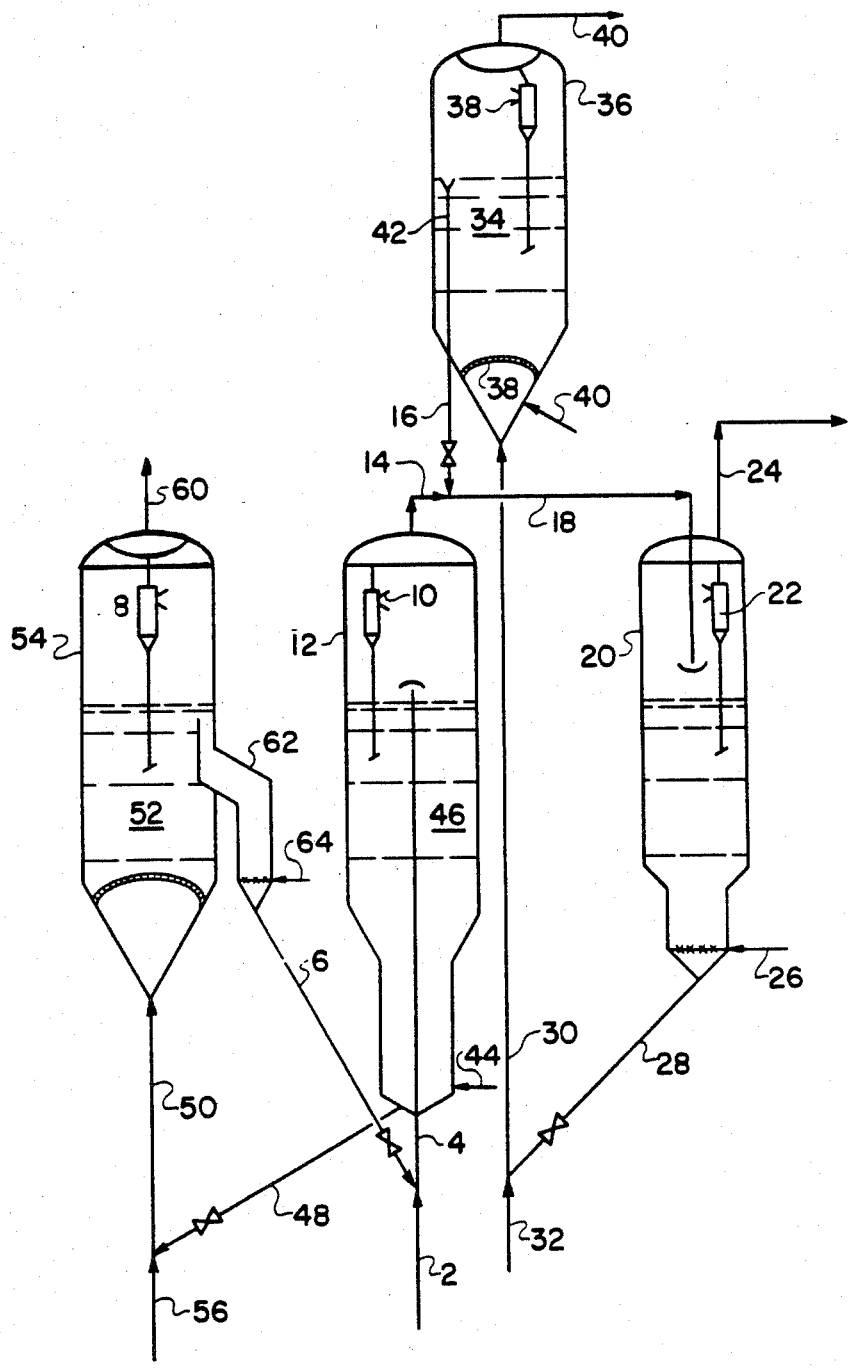
40
38
36
42
34
38
40
16
14
18
24
60
8
54
10
12
22
20
62
52
46
64
6
26
30
44
28
50
4
48
32
2
56

COMBINATION PROCESS FOR UPGRADING RESIDUAL OILS

CONTINUING DATA

This application is a continuation of Ser. No. 401,059, filed 7/23/82, and now adandoned.

It is recognized at this stage of the petroleum refining art that metals containing heavy oils such as residual oils boiling above 650° F., reduced crude and vacuum tower bottoms are less than desirable charge stocks for crystalline zeolite catalytic cracking operations because Conradson carbon producing components and metal contaminants reduce the catalyst activity and cause undesired amounts of coke and dry gas to be produced at the expense of producing desired products including gasoline. Metal contaminants of iron, nickel, vanadium, copper and sodium alter the cracking activity and selectivity of a zeolite cracking catalyst contributing to the formation of poor quality and distribution of products.

Crude oils comprising metallo-organic compounds are known in which from 30 to 60% or more of the total volume comprise compounds boiling above 650° F. with from about 10 to 30 volume percent of the total volume comprising compounds boiling above about 1025° or 1050° F. at atmospheric pressure. Because of the scarcity of high quality gas oil boiling range material boiling from about 650° F. up to about 1025° F., it is now necessary to develop economically efficient processes for converting more of the crude barrel comprising components boiling above about 1000° F. or 1025° F. to lower boiling desired products including gasoline.

Crude oils in the natural state contain a variety of metall-organic compounds which contribute to undesirable catalyst functions in cracking the heaviest or resid portion of a crude oil feed. Among these compounds are coke precursors (such as asphaltenes, and polynuclear aromatics comprising at least 5 ring compounds); heavy metals such as iron, nickel, vanadium, copper as free metals or combined as porphyrins are present along with catalyst deactivating amounts of sodium, potassium, sulfur and nitrogen materials. Materials such as high boiling coke precursors, asphaltenes and the like tend to break down into coke during the cracking operation, which deposits on the catalyst as carbonaceous or hydrocarbonaceous material thereby substantially inactivating the catalyst and particularly its catalytic selectivity. Metal deposits further contribute to this inactivation of catalyst particle and such may be terminal deactivation for a crystalline zeolite containing cracking catalyst. It has been determined that heavy metals transfer almost quantitatively from the feedstock to a catalyst particle surface.

Numerous proposals are presented in the prior art for upgrading poor quality feeds for the removal of contaminating metals and Conradson carbon contributing components. These proposals include the combination of one of more of vacuum distillation, solvent extraction, hydrotreating and complexing with added solid metals either catalytic or non-catalytic in function. However, these various proposals are all criticized as economically unattractive when processing high cost crude oil. Thus, in order to reduce the economics of the process and yet increase the yield or more desired products from the total barrel of high cost crudes other processing innovations are desperately needed.

The prior art of U.S. Pat. Nos. 2,472,723 Peet; 2,956,004 Conn et al and 3,146,188 Gossett all address themselves to techniques for upgrading poor quality crudes by a combination operation involving decarbonizing and demetallizing the high boiling residual oil feed and subjecting an obtained gas oil feed of improved quality to fluid catalytic cracking. However, each of these operations also embody steps which are economically unattractive in the present day requirements for upgrading the bottom of the crude barrel.

The present invention addresses itself particularly to a more efficient and economic upgrading of poor quality crude oil and particularly that portion of the crude barrel boiling above atmospheric gasoline including middle distillate, gas oils and the resid portion of the crude barrel boiling above 1000° F. and more particularly that portion boiling above 1025° F. Thus, the inventive concepts of the present invention include eliminating or reducing all uneconomic processing steps heretofore relied upon for upgrading topped crude oil and residual portions thereof in the production of more useful products including gasoline, gasoline precursors and light cycle oils.

SUMMARY OF THE INVENTION

This invention is directed to an efficiently improved method and means for reducing dry gas and coke make as well as capital and operating costs of a combination process for effecting upgrading and conversion of reduced crudes and residual portions of crude oils to gasoline boiling range products and light fuels. More particularly, the invention is directed to a combination operation comprising a first stage decarbonization and demetallization of residual oils comprising metal contaminants and Conradson carbon producing components boiling above 1050° F. to produce vaporous product of visbreaking which are thereafter immediately contacted in the absence of cooling or produce separation with a high activity crystalline zeolite cracking catalyst in a second stage under conditions providing gasoline, gasoline precursor and light cycle oils. Of particular interest is the fact that the combination operation of this invention eliminates substantial processing equipment for the condensation and heating of products between stages as well as the recovery of certain special fractions thereof to be thereafter processed in a downstream catalytic cracking operation. According to the operating concept this eliminates heat losses and expensive processing equipment as well as operating expense thereof, lowers coke and dry gas make in combination with increasing the useful liquid products from the crude barrel. In yet another aspect, hydrogen produced in the first stage visbreaking operation is cascaded and used in the second stage crystalline zeolite catalytic cracking operation comprising hydrogen transfer activity. Thus the combination operation of this invention is substantially thermally more efficient by reducing heat losses encountered in known and disclosed prior art processes.

In accordance with the processing concepts of this invention, a reduced crude or a residual portion of crude oil comprising components boiling above 1025° F. including asphaltenes, porphyrins and multi-ring compounds of at least 5 rings recovered from atmospheric distillation is initially processed in a riser contact zone under conditions particularly selected to accomplish substantial visbreaking including decarbonization and demetallization of the heavy residual oil feed higher boiling components by contact with hot solid sorbent particle material of little or no catalytic cracking activity in the presence of an active or non-reactive diluent material contributing to rapid atomized oil dispersion contact with dispersed phase fluidized sorbent particles for a restricted contact time less than 2 seconds at a temperature providing a product vapor at a temperature in the range of 900° to 1050° F. The hot product vapors with or without some entrained fines of sorbent particles are thereafter immediately brought in direct high temperature contact with an active crystalline zeolite containing cracking catalyst recovered from catalyst regeneration in a second restricted dispersed catalyst phase contact zone permitting a selective and restrictive control in the contact time between an active crystalline zeolite cracking catalyst particles and formed vaporous material recovered from the first solid sorbent particle stage of contact. The second stage dispersed cracking catalyst phase contact zone may be an elongated conduit arranged for horizontal flow, upflow or downflow dispersed phase ccontact with the vaporous product of visbreaking or a combination thereof depending on equipment utilized which will permit restricting the contact time between vaporous material and catalyst particles to less than 2 seconds at an elevated cracking temperature condition particularly providing substantial yields of gasoline and gasoline precursors. The cracking operation with the crystalline zeolite catalyst is of such duration and catalyst-oil vapor temperature profile to provide a selective cracked product temperature at the discharge of the second stage catalytic contact zone within the range of 900° to 1050° F.

In the combination operation of this invention, solids sorbent particle contact material separated from vaporous products of a selective thermal visbreaking operation and separated catalyst particles recovered from a selective cracking operation are charged to their respective catalyst regeneration operations for removal of deposited carbonaceous material by combustion with oxygen containing regeneration gases. Solid sorbent particle material and active crystalline zeolite containing catalyst particles are each separately recovered from their respective regeneration zones at a temperature in the range of 1050° F. up to 1600° or 1800° F. depending on use as herein defined for recycle to their appropriate hydrocarbon contact zone. Generally, the recycled solid sorbent particle material will be recycled at a higher temperature than the recycled zeolite containing catalyst particles.

The solid sorbent particle contact material employed in the first stage of contact with residual oil feed is for effecting a selective visbreaking of the residual oil feed as herein discussed. Any sorbent particle material suitable for the purpose and disclosed in the prior art such as calcined clays, kaolin being preferred, spent or catalytically insufficient cracking catalyst no longer suitable for its intended purpose may be used. The crystalline zeolite containing cracking catalyst may be selected from any one of a number of different cracking catalysts also disclosed in the prior art and comprising from 1 to 40 weight percent of an active crystalline zeolite dispersed in a suitable inorganic oxide-clay matrix material. The crystalline zeolite employed may be of a hydrogen form of faujasite crystalline zeolite or a rare earth exchanged faujasite of either the X or Y form of faujasite crystalline zeolite: The catalyst composition may be tailored to achieve a particular product selectivity by varying the zeolite content of the catalyst and the use of one or more promoters disclosed in the art.

The drawing is a diagrammatic sketch in elevation of an arrangement of apparatus suitable for upgrading high boiling residual oils following the techniques and concepts of this invention.

Referring now to the drawing by way of example, a high boiling residual oil feed such as a topped crude or a reduced crude comprising components boiling above 1025° F., metal contaminants and Conradson carbon contributing material is charged to the process by conduit 2 following recovery from for example an atmospheric distillation zone and generally comprising components boiling above 650° or 700° F. The residual oil feed is preferably mixed with a diluent dispersant material to aid dispersed atomized contact in a riser reactor with solid sorbent fluid particle material in conduit 6 charged to the riser at an elevated temperature in the range of 1400° to 1700° F. The charged residual oil feed and solids to the riser contact zone 4 forms an upflowing dispersed phase suspension therein of predetermined and selected particle concentration in the range of 1/1 up to 10 to 1 on a weight basis. The riser contact zone 4 is of a length permitting a hydrocarbon residence time therein less than about 2 seconds under velocity conditions providing for a suspension plug flow operation absent formation of a dense fluid bed of solid particles in the riser. Preferably, the hydrocarbon residence contact time within the riser is within the range of 0.5 to 1 second and such may be attained in a long riser contact zone by charging the residual oil feed to a downstream portion of the riser for contact with preformed upwardly flowing suspension of fluid solids in a fluidizing gas such as steam, dry gas, wet gaseous product, $CO_2$ or a combination thereof suitable for the purpose. In this specific operating environment, the residual oil feed is subjected to a selective time and temperature controlled operation selected to particularly reduce the end boiling point of the feed below about 1050° F. by cracking multi-ring components to lower orders and effect demetallization and decarbonizing of the feed in an acceptable amount. Employing relatively high temperature solids at high velocity in a solids to oil feed ratio of at least about 1 but less than about 5 at a short residence time less than 2 seconds is effective for this purpose. It is critical to the operating concepts and essence of this invention to achieve rapid separation of the suspension following a selected residence time within riser 4 so that formed vaporous material may be brought immediately in direct contact with a high activity zeolite containing cracking catalyst before coke formation can substantially occur and catalytic cracking can be particularly relied upon for formation of desired product vapors. Thus, it is desirable to restrict the contact time between the hydrocarbon feed contact with solid sorbent particle material and vaporous products thereof brought in contact with an active crystalline zeolite cracking catalyst and the total time of this combination should prefereably not exceed 3 seconds and more preferably the time span that the hydrocarbons are in contact with sorbent and catalyst particles should not substantially exceed about 2 seconds. It will thus be apparent to those skilled in the art that very sophisticated and highly efficient separation technique must be employed to separate a high velocity suspension of sorbent particles from vaporous products of visbreaking before effecting immediate contact of selectively formed vapors with the active fluid cracking catalyst.

In the arrangement of the drawing the suspension following traverse of a relatively short riser 4 is shown initially separated by an inverted dish shaped baffle spaced above the riser outlet or open end thereof and adjacent the entrance of cyclone separation means for vaporous material with entrained fines which pass through the cyclone separating means 10 within vessel 12. On the other hand, the suspension in riser 4 may be separated by other techniques known such as ballistic separation disclosed in U.S. Pat. Nos. 4,070,159 and 4,066,533 and copending application Ser. No. 06/304,992 or the suspension may be discharged directly into cyclone separating means or by one or more other suitable techniques known and disclosed in the prior art. Hot vaporous material thus substantially separated from solid sorbent fluid contact material is withdrawn by conduit 14 from vessel 12 and immeidately mixed with hot regenerated catalyst particles in standpipe 16 at a temperature in the range of 1050° to 1300° F. to form a high velocity relatively dispersed phase suspension thereof at a solids to vaporous hydrocarbon ratio in the range of 3 to 8 flowing at a velocity up to about 100 feed per second through a cracking conduit 18 of restricted size and configuration suitable for the restricted time-temperature catalytic cracking operating concept of this invention.

In the arrangement of the drawing cracking conduit 18 is shown initially horizontal and communicating with a vertical section which discharges downwardly into the upper portion of vessel 20 and adjacent to the mouth of one or more suitably positioned cyclones 22. The discharge end of conduit 18 may be adjacent a dish shaped baffle means which will aid separation of the suspension. On the other hand, the technique of ballistic separation may be utilized downflowing in conjunction with one or more suitable baffle arrangement means spaced below the open discharge end of conduit 18. The cross sectional discharge end of conduit 18 may be closed and provided with vertical slots in the wall periphery thereof adjacent the closed end of the reactor conduit through which the product suspension is passed and discharge separated on a momentum differential basis operating in conjunction with cyclone spearating means. Vaporous products of cracking are separated from entrained fines in a plurality of cyclone separating means represented by cyclone 22 before withdrawal by conduit 24 for passage to a main column fractionation operation not shown.

Catalyst particles separated from vaporous cracked hydrocarbon products are collected in a lower portion of vessel 20 wherein they are maintained in a relatively dense downflowing fluid bed condition countercurrent to rising stripping gas such as steam charged by conduit 26. The stripped catalyst particles at an elevated temperature of about 900° F. or higher is withdrawn by conduit 28 for passage to a riser contact or regeneration zone 30 to which regeneration air is charged by conduit 32. Combustion of carbonaceous deposits on the catalyst particles may be implemented by adding hot regenerated catalyst particles to the spent catalyst particles charged to the bottom portion of a dense fluid bed of catalyst particles 34 being regenerated by combustion of carbonaceous deposits with oxygen containing gas in regeneration zone 36. A perforated baffle member 38 or other suitable air distributor grid means is provided in a lower portion of vessel 36 for distributing charged catalyst particles and regeneration gas. However, riser 30 may terminate above grid 38 so that only combustion air separately added passes through this grid. Additional regeneration gas may be added to the catalyst bed 34 as recited above or by one or more inlets represented by inlet conduit 40. In this catalyst regeneration operation, carbonaceous material deposits on the catalyst is substantially completely removed by combustion to provide high temperature catalyst particles restricted to a temperature within the range of 1000° F. to 1350° F. and more usually not above 1300° F. with or without some retained residual carbon thereon not substantially above about 0.1 or 0.2 weight percent. The crystalline zeolite containing catalyst regeneration operation completed in vessel 36 may encompass some variations on that specifically shown in the drawing. For example, vessel 36 may be separated by a vertical baffle extending from the bottom thereof upwardly a sufficient distance to provide for an upflowing dense catalyst bed regeneration zone on one side of the baffle and a down flowing dense catalyst bed regeneration zone on the opposite side of the baffle thus providing for a two stage temperature restricted and controlled catalyst regeneration operation with a common dispersed catalyst phase above each dense catalyst bed phase.

In the arrangement of the drawing, flue gas combustion products pass through a plurality of cyclone separating means represented by cyclone 38 for removal of entrained catalyst fines. The flue gases thus separated from catalyst fines and comprising $CO_2$ or $O_2$ depending on the regeneration operation pursued are recovered by conduit 40 for use as desired and known in the prior art.

Regenerated catalyst at an elevated temperature preferably in the range of 1050° to 1350° F. is withdrawn from catalyst bed 34 by standpipe 42 for reuse as above discussed in reactor conduit 18. It is contemplated adding a catalyst cooler in standpipe 16 to further adjust the temperature of the regenerated catalyst particles as required.

Referring now to the first stage of the combination operation comprising residual oil feed contact with solid sorbent particle material, the contacted solids separated from vaporous material as above discussed are collected as a downwardly moving fluid bed of solids 46 passing countercurrent to rising stripping gas charged by conduit 44. Stripping gas which may or may not be reactive with high temperature deposited carbonaceous material at an elevated temperatures in the stripping operation may be employed for example to produce a hydrogen containing gas. The stripping gas is charged to a lower bottom portion of the downwardly flowing bed 46. It is contemplated adding hot regenerated solids to bed 46 to aid obtaining a high temperature stripping operation. The stripped solids are recovered by standpipe 48 for passage to a riser contact zone 50 discharging into a bottom portion of a bed of solids 52 being regenerated in zone 54. Regeneration gas such as air or an oxygen containing gas with or without steam is charged by conduit 56 to a bottom portion of riser 50 for admixture with solids charged by conduit 48 to form an upflowing suspension thereof. Although not specifically shown, it is also contemplated adding hot regenerated solids from bed 52 directly to a bottom portion of riser 50 for admixture with stripped solids comprising carbonaceous deposits to raise the temperature thereof more rapidly to combustion supporting temperatures.

Regeneration vessel 54 may also be modified with a vertical baffle member to provide for upflow solids regeneration on one side of the baffle and downflow solids regeneration on the other side thereof thereby providing a two stage regeneration operation more easily temperature regulated and provided with a common dispersed solids phase thereabove.

Flue gas products of combustion comprising $CO_2$ with or without CO or oxygen pass through a plurality of cyclone separating means generally represented by cyclone 58 wherein entrained fines are separated from the flue gas before withdrawal by conduit 60. Regenerated solid particulate material is withdrawn in the arrangement of the drawing into an external stripping zone 62 to which stripping gas is charged by conduit 64. The stripped solid sorbent at an elevated temperature in the range of 1300° to 1800° F. is withdrawn and passed by standpipe conduit 6 to a lower bottom portion of riser 4 for use as above discussed in decarbonizing and demetallizing a resid comprising residual oil feed material charged by conduit 2.

It will be recognized by those skilled in the art that the apparatus of the invention may be varied considerably for achieving the special operating results particularly contemplated by the concepts of this invention. That is regeneration of solids and catalyst particles may be accomplished in a variety of different arrangements comprising single or multiple stages of regeneration to produce solids of desired temperature and residual coke level in combination with flue gaseous products varying substantially in composition. However, the constraints essential to the operating concepts of this invention are particularly directed to a selective and restrictive visbreaking decarbonizing operation under conditions reducing primarily the end boiling point of the charged heavy oil resid components to below 1050° F. and contacting the total vaporous products thereof substantially immediately with an active crystalline zeolite cracking catalyst. The suspension formed with vaporous hydrocarbons and active cracking catalyst may initially pass downwardly through a curved restricted contact zone penetrating a side wall of vessel 20 for rapid separation of the suspension above a collected bed of catalyst particles in a lower portion of vessel 20. Thus the time-temperature restrictions imposed by the operating concepts of this invention are particularly directed to a selected and restrictive visbreaking operation; the method of separating the formed vaporous hydrocarbon solids suspension thereof so that an immediate contact of the high temperature hydrocarbon vapors of visbreaking can be subjected in the absence of cooling and undesired thermal cracking to a further selective crystalline zeolite catalytic cracking operation. The combination of the thus identified hydrocarbon contact operations and separation of solid particle comprising suspensions being restricted to a combined time frame of less than 3 seconds and preferably the combined time of the combination operation should not exceed about 2 or 2.5 seconds.

Having thus generally described the method and concepts of this invention and specifically described an operating method and means in support thereof, it is to be understood that no undue restrictions are to be imposed by reason thereof except as defined by the following claims.

We claim:

1. A method for converting heavy residual oil feeds comprising metallo-organic compounds boiling above 1050° F. to produce gasoline boiling products which comprises, A. contacting said residual oil feed for less than about two seconds in substantially plug flow with solid sorbent fluid particle material in a first transport zone at an elevated temperature and for a time sufficient to demetallize and decarbonize said residual oil feed and thermally visbreak multi-ring compounds boiling above 1050° F. to vaporous material boiling below 1050° F., separating vaporous materials from solid sorbent particle material, B. thereafter immediately contacting said separated vaporous material with an active high temperature crystalline zeolite cracking catalyst discharged by a standpipe to form a flowing suspension in plug flow therewith in a second lateral transport reaction zone above the first transport zone at a temperature within the range of 1050° F. to 1350° F. for a period of time less than about 3 seconds, C. discharging the suspension in said second transport zone downwardly into a product vapor-catalyst separation zone, recovering vaporous products of said zeolite catalyst cracking operation separately from catalyst particles in said product separation zone, D. regenerating said solid sorbent particles material and recycling said material for contact with additional heavy oil feed.

2. The method of claim 1 wherein the lapse of time between recovery of vaporous material from solid sorbent material and contact with said crystalline zeolite cracking catalyst to form a suspension therewith is a fraction of a second and without significant cooling of the recovered vaporous materials.

3. The method of claim 1 wherein the solid sorbent fluid particle material is selected from relatively inert clays and cracking catalyst comprising little if any catalytic cracking activity.

4. The method of claim 1 wherein demetallization and decarbonization of the heavy oil feed with solid sorbent material is at least 75 or 80 percent before contact of formed vaporous product thereof with said zeolite cracking catalyst.

5. The method of claim 1 wherein exposure of the residual oil feed to contact with solid sorbent material at an elevated visbreaking temperature is restricted to not exceed about 1 second and vaporous products thereof are brought in contact with a suspended crystalline zeolite cracking catalyst in a time frame less than a fraction of a second from the time of separation from inert solids, said suspension of hydrocarbon vapors and zeolite cracking catalyst passed through a transport zone for a period of time sufficient to convert vaporous material to gasoline boiling range material.

6. The method of claim 1 wherein the residual oil is upgraded thermally with inert sorbent material in the presence of a normally gaseous product of catalytic cracking comprising hydrogen, said solid sorbent particle to oil feed ratio being in the range of 2–6 to 1 on a weight basis in a riser at a suspension velocity below about 100 ft./sec.

7. The method of claim 1 wherein the vaporous hydrocarbon product of the inert solid contact is catalytically converted to gasoline and gasoline precursors with dispersed phase catalyst particle at a concentration in the range of 3–10 to 1 on a weight basis at a suspension velocity below 100 ft./sec.

8. The method of claim 1 wherein the solid sorbent particles and the catalyst particles separated from transport contact zones are separately stripped at an elevated temperature equal to or above the temperature recovered from their respective elongated confined transport zones.

9. The method of claim 1 wherein the separated solid sorbent particles are regenerated at a higher temperature than the temperature relied upon to regenerate catalyst particles.

10. The method of claim 1 wherein said vaporous hydrocarbon product separated from solid sorbent material is contacted with catalyst particles at a catalyst to oil ratio of 6–8 on a weight basis.

11. The method of claim 1 wherein catalytic cracking of vaporous hydrocarbon product is effected with suspended catalyst in a transport zone under temperature and contact time conditions providing a transport reactor zone outlet temperatue in the range of 950° F. up to about 1150° F.

* * * * *